US008806812B2

(12) United States Patent
Kolovich et al.

(10) Patent No.: US 8,806,812 B2
(45) Date of Patent: Aug. 19, 2014

(54) ADJUSTABLE DOOR FRAME ASSEMBLY AND METHOD OF INSTALLATION

(75) Inventors: Michael A. Kolovich, Newton Falls, OH (US); Daniel Perry, Gorham, ME (US); Scott Willson, Bookline, MA (US); Eric E. Hunt, Warren, OH (US); Fredrick John Bloom, III, Warren, OH (US)

(73) Assignee: Black Mountain Door, LLC, Mt. Sterling, KY (US)

( * ) Notice: Subject to any disclaimer, the term of this patent is extended or adjusted under 35 U.S.C. 154(b) by 156 days.

(21) Appl. No.: 12/694,340

(22) Filed: Jan. 27, 2010

(65) Prior Publication Data

US 2011/0179730 A1 Jul. 28, 2011

(51) Int. Cl.
*E04B 2/82* (2006.01)

(52) U.S. Cl.
USPC ..... 52/126.4; 52/204.1; 52/126.1; 52/212; 52/126.3; 52/208

(58) Field of Classification Search
USPC ..... 52/204.2, 211, 212, 213, 215, 217, 52/126.1, 126.3, 126.4, 208, 204.54; 49/504
See application file for complete search history.

(56) References Cited

U.S. PATENT DOCUMENTS

| | | | | | |
|---|---|---|---|---|---|
| 2,728,956 | A * | 1/1956 | Jackson | 49/380 |
| RE24,285 | E * | 3/1957 | Jackson | 52/215 |
| 2,860,744 | A * | 11/1958 | Mascari | 52/212 |
| 3,571,995 | A * | 3/1971 | Kasprzak | 52/212 |
| 3,861,099 | A * | 1/1975 | Faudree | 52/211 |
| 3,906,671 | A * | 9/1975 | Maldonado | 49/505 |
| 4,128,977 | A * | 12/1978 | Schubeis | 52/212 |
| 4,813,204 | A * | 3/1989 | Rentschler | 52/217 |
| 4,829,727 | A * | 5/1989 | Kuzara, Jr. | 52/127.2 |
| 4,878,325 | A * | 11/1989 | Van Tuyl et al. | 52/217 |
| 5,233,082 | A | 8/1993 | Fertel et al. | |
| 5,233,802 | A * | 8/1993 | Rogers | 52/212 |
| 5,787,660 | A * | 8/1998 | Adams | 52/212 |
| 6,178,717 | B1 * | 1/2001 | Loop | 52/714 |
| 6,286,274 | B1 * | 9/2001 | McKann et al. | 52/204.1 |
| 6,550,193 | B2 * | 4/2003 | Potts | 52/204.1 |
| 7,516,581 | B2 * | 4/2009 | Vidal | 52/204.1 |
| 7,621,083 | B2 * | 11/2009 | Smith | 52/212 |
| 2003/0046886 | A1 * | 3/2003 | Potts | 52/212 |
| 2005/0193652 | A1 * | 9/2005 | Cornell | 52/204.1 |
| 2005/0193653 | A1 * | 9/2005 | Cornell | 52/204.1 |

OTHER PUBLICATIONS

Five (5) pages illustrating products sold by Amweld Building Products or publically shown more than one year before the filing date of the subject application.

* cited by examiner

*Primary Examiner* — Robert Canfield
*Assistant Examiner* — Matthew Gitlin
(74) *Attorney, Agent, or Firm* — Deam B. Watson

(57) ABSTRACT

The present disclosure includes an adjustable door frame assembly and method for framing a door opening. The adjustable door frame assembly comprises first and second alignment members providing a first securing structure to a door opening, one of the first and second alignment members being rotatably connected to a door during installation. The adjustable door frame assembly further comprises an alignment header connecting the first and second alignment members along an upper end of the alignment members and an alignment assembly located within at least one of the first and second alignment members. The alignment assembly comprises an adjustable stop for locating the adjustable door frame assembly about the door opening. The adjustable door frame assembly also comprises first and second cover members providing a second securing structure to the door opening independently of the first securing structure.

8 Claims, 10 Drawing Sheets

ADJUSTABLE DOOR FRAME ASSEMBLY AND METHOD OF INSTALLATION

TECHNICAL FIELD

The present disclosure relates to an adjustable door frame assembly and method of installation, and more specifically, an adjustable door frame assembly that accommodates variations in door opening sizes and is constructed for ease of assembly and aesthetic appeal.

BACKGROUND

New construction along with pre-fabricated commercial buildings, residential buildings, and homes are typically designed with at least one rough opening for an enclosure such as a conventional hinged door. Conventional techniques would typically require a carpenter or skilled tradesman to install a custom header and casings sized to accommodate the selected door assembly for the specified opening. Typically one of two vertical jambs forming the sides of the rough opening would include hinges for attaching to the door for pivotal movement and the other of said jambs would include a strike plate for latching the door in a closed or locked position. The vertical jambs and a header horizontally connecting the vertical jambs are typically plumbed and squared during installation of the door assembly in the rough opening by placing wooden shims between the jambs and rough opening around its perimeter. Such conventional custom build approach is labor, cost, and time intensive.

To reduce the costs associated with the custom on-site door construction, door assemblies are now prefabricated to fit the rough opening in the home or building. However, in order to meet the desires of home or building owners' needs, the width of the rough openings would vary as a result of the differing thicknesses of the walls. Undesirably, a large inventory of prefabricated door assemblies would result in order to accommodate the unlimited number of wall thickness sizes. In addition to the surplus inventory problems relating to prefabricated doors, conventional custom build approach as well prefabricated doors typically leave screws and nails exposed from the outside of a door casing surrounding the door jambs and header.

SUMMARY

One example embodiment of the present disclosure includes an adjustable door frame assembly for framing a door opening. The adjustable door frame assembly comprises first and second alignment members providing a first securing structure to a door opening, one of the first and second alignment members being rotatably connected to a door during installation. The adjustable door frame assembly further comprises an alignment header connecting the first and second alignment members along an upper end of the alignment members and an alignment assembly located within at least one of the first and second alignment members. The alignment assembly comprises an adjustable stop for locating the adjustable door frame assembly about the door opening. The adjustable door frame assembly also comprises first and second cover members providing a second securing structure to the door opening independently of the first securing structure.

Another example embodiment of the present disclosure includes a method for installing a door frame assembly within an opening of a wall. The method comprises setting a door attached to an alignment header and alignment members into a wall opening and squaring the alignment members, alignment header, and door with the opening by adjusting an alignment assembly. The method also comprises securing the alignment members and alignment header forming a first arrangement to the wall opening. The method also comprises engaging the first arrangement with a cover assembly and securing the cover assembly to the rough opening.

A further example embodiment of the present disclosure includes an adjustable door frame assembly for framing a door opening. The adjustable door frame assembly comprises two vertical jamb arrangements connected by a horizontal head arrangement, defining a run-out region. The adjustable door frame assembly further comprises two alignment members spacially connected by an alignment header forming a portion of the vertical jamb arrangements and horizontal head arrangement, respectively having a concealing channel. Two cover members are spacially connected by a cover header forming the remaining portion of the vertical jamb arrangements and horizontal head arrangement, respectively having a surround segment. The surround segment of the cover members are variably located within the concealing channel of the alignment members and the surround segment of the cover header is variably located within the concealing channel of the alignment header. The run-out region is formed by the operable locating of the surround segments within respective concealing channels, hiding any variation in a wall thickness about a rough opening during installation of the adjustable door frame assembly.

BRIEF DESCRIPTION OF THE DRAWINGS

The foregoing and other features and advantages of the present disclosure will become apparent to one skilled in the art to which the present disclosure relates upon consideration of the following description of the invention with reference to the accompanying drawings, wherein like reference numerals, unless otherwise described refer to like parts throughout the drawings and in which.

DETAILED DESCRIPTION

The present disclosure relates to an adjustable door frame assembly and method of installation, and more specifically, an adjustable door frame assembly that accommodates variations in door opening sizes and is constructed for ease of assembly and aesthetic appeal. The adjustable door frame assembly of the present disclosure is constructed such to accommodate various wall thicknesses ranging from three (3") inches to four (4') feet while concealing any fasteners in a cover surrounding the adjustable door frame assembly that provides a visually aesthetic appeal to the owner and/or consumer.

Figure 1:
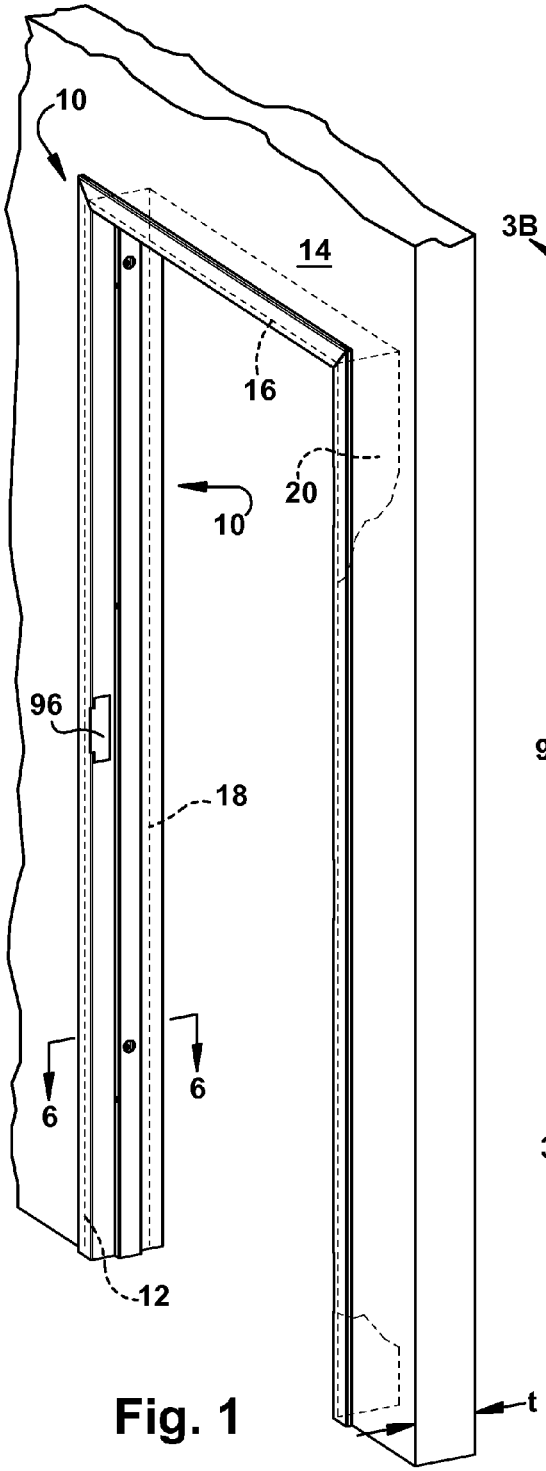
FIG. 1 is a perspective assembly view of an adjustable door frame assembly constructed in accordance with one embodiment of the present disclosure installed within a rough opening of a wall in a commercial building or residential home.
Figure 2:
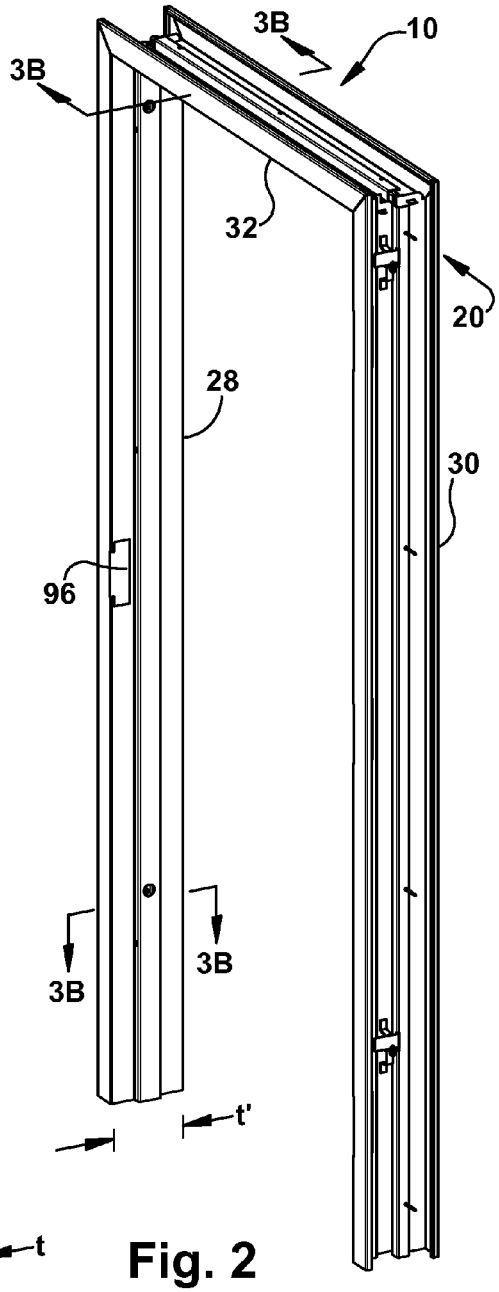
FIG. 2 is a perspective view of an adjustable door frame assembly constructed in accordance with one embodiment of the present disclosure.
Figure 8:
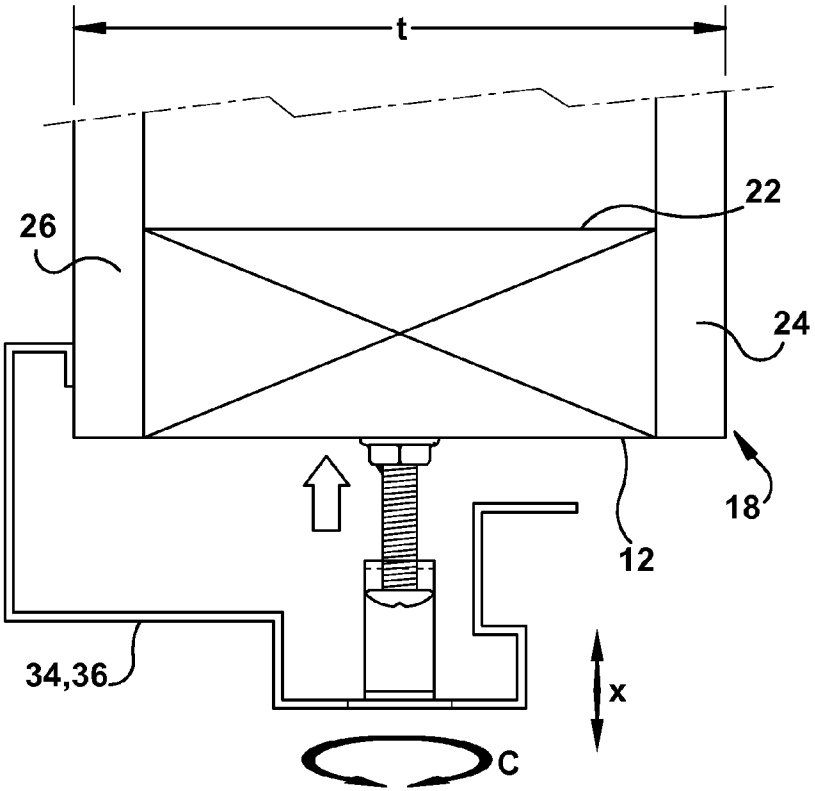
FIG. 8 is a plan view of an alignment assembly engaging a rough opening in accordance with one embodiment of the present disclosure.

Referring to the figures and in particular, FIG. 1 is a perspective view of an adjustable door frame assembly 10 constructed in accordance with one example embodiment of the present disclosure. The adjustable door frame assembly 10 in FIG. 1 is fixedly attached into a rough opening 12 (shown in phantom behind the adjustable door frame assembly) formed within a wall 14 of a commercial building or residential home. The rough opening 12 in the wall 14 includes a header 16 and vertical sides 18 and 20, all typically of substantially the same thickness. In particular, the header 16 and sides 18, 20 are typically formed from one or more wooden or steel studs 22 sandwiched between two pieces of drywall 24, 26 as best seen in FIG. 8. In a conventional wall, the thickness t is approximately four and seven-eighth's inches (4⅞").

The adjustable door frame assembly 10 comprises two vertical jamb arrangements 28 and 30 and a horizontal head arrangement 32. The vertical jamb and horizontal head arrangements are constructed from metal, and in one example embodiment, the metal is cold-rolled steel or galvannealed steel. The horizontal head and vertical jamb arrangements could be equally formed from other metals or plastics of equal strength without departing from the spirit and scope of the claimed invention. In the illustrated embodiment, the jamb and head arrangements 28, 30, and 32 are formed from 16 ga flat stock steel and bent to the desired configuration using a brake press.

Figure 3A:
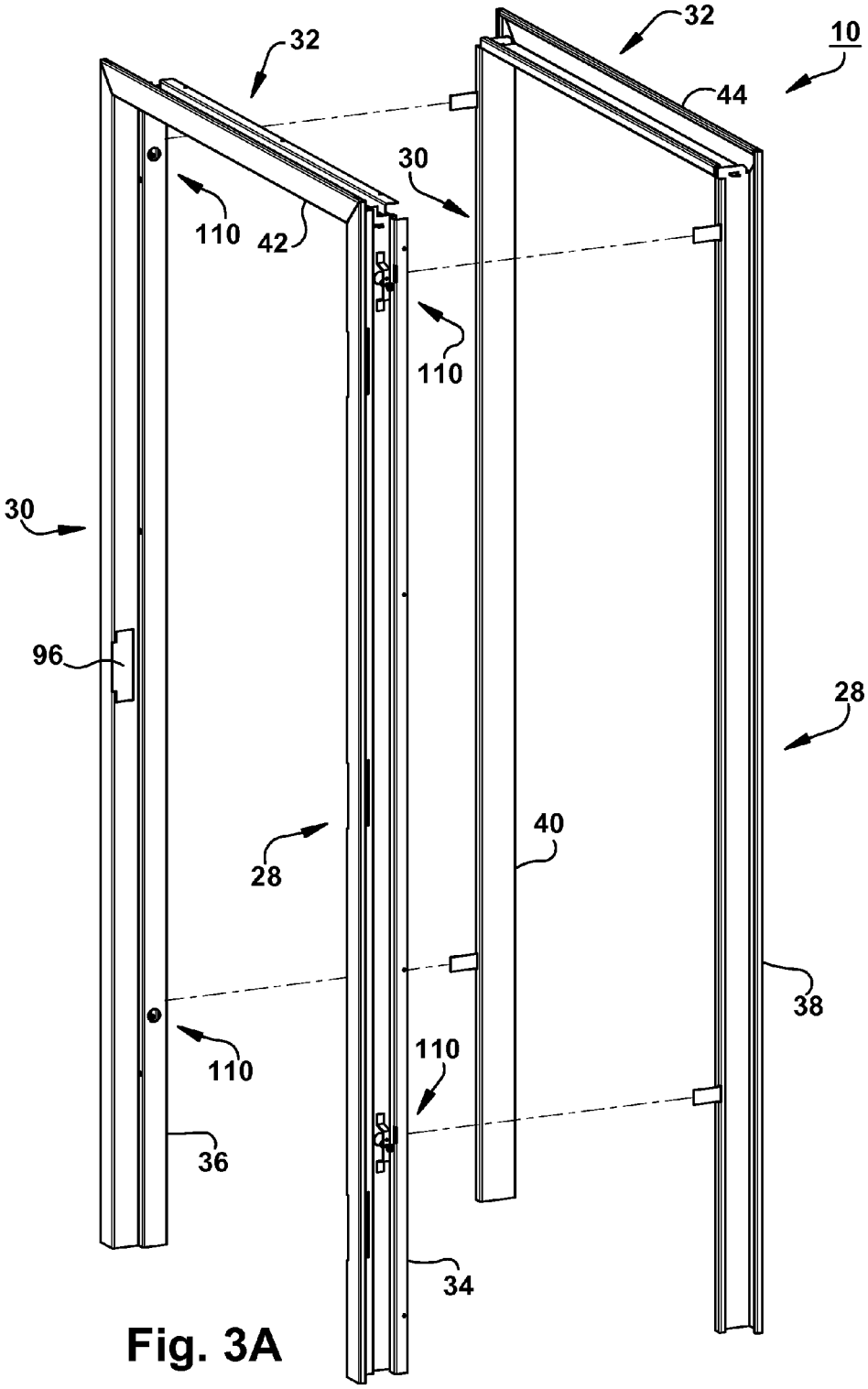
FIG. 3A is an exploded perspective view of the adjustable door frame assembly of FIG. 2.

Illustrated in FIG. 3A is an exploded-perspective view of vertical jamb and horizontal head arrangements 28, 30, and 32. The vertical jamb arrangements 28 and 30 further comprise corresponding alignment members 34 and 36, respectively and corresponding cover members 38 and 40, respectively, as best seen in FIG. 3A. The both alignment members 34, 36 and cover members 38 and 40 are independently fixedly attached to the rough opening 12 as further discussed below. In addition, the vertical jamb arrangements 28, 30, and head arrangement 32 maintain a similar interior profile 41 surrounding the door (see FIG. 3B) even though their respective attachments to the rough opening 12 are different.

The horizontal head arrangement 32 comprises alignment header 42 and cover header 44. The alignment header 42 interconnects the respective alignment members 34, 36 by extending tabs 46 at both ends 48, 50 of the alignment header through corresponding slots 52 located in the alignment members. The cover header 44 interconnects the respective cover members 38, 40 by extending tabs 54 at both ends 48, 50 of the cover header through corresponding slots 56 located in the cover members.

Figures 3B, 4:
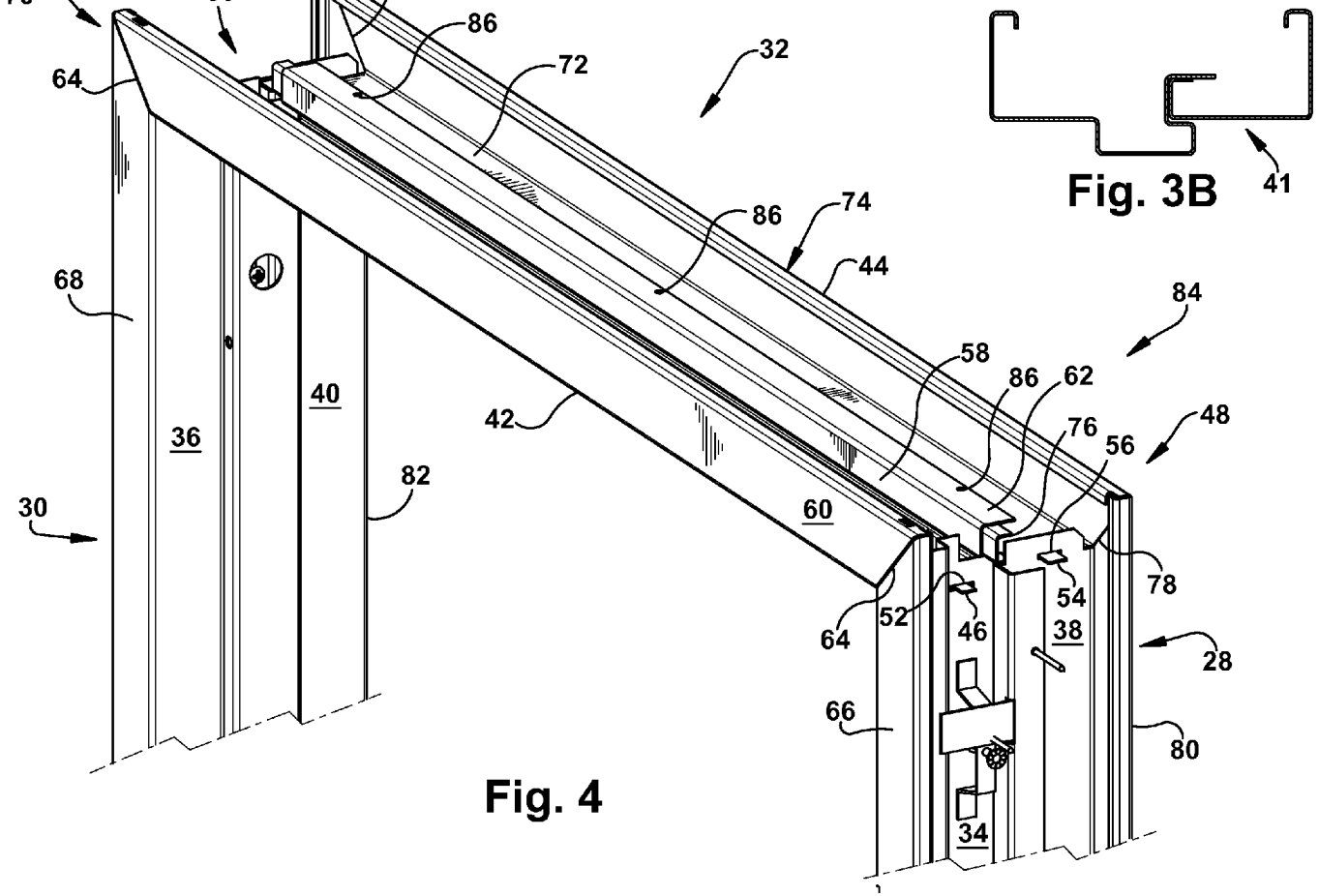
FIG. 3B is a cross-sectional view of an inner view of a vertical jamb or horizontal header arrangement about section lines 3B-3B in FIG. 2.
FIG. 4 is a magnified partial perspective view of the adjustable door frame assembly illustrated in FIG. 2.
Figure 5:
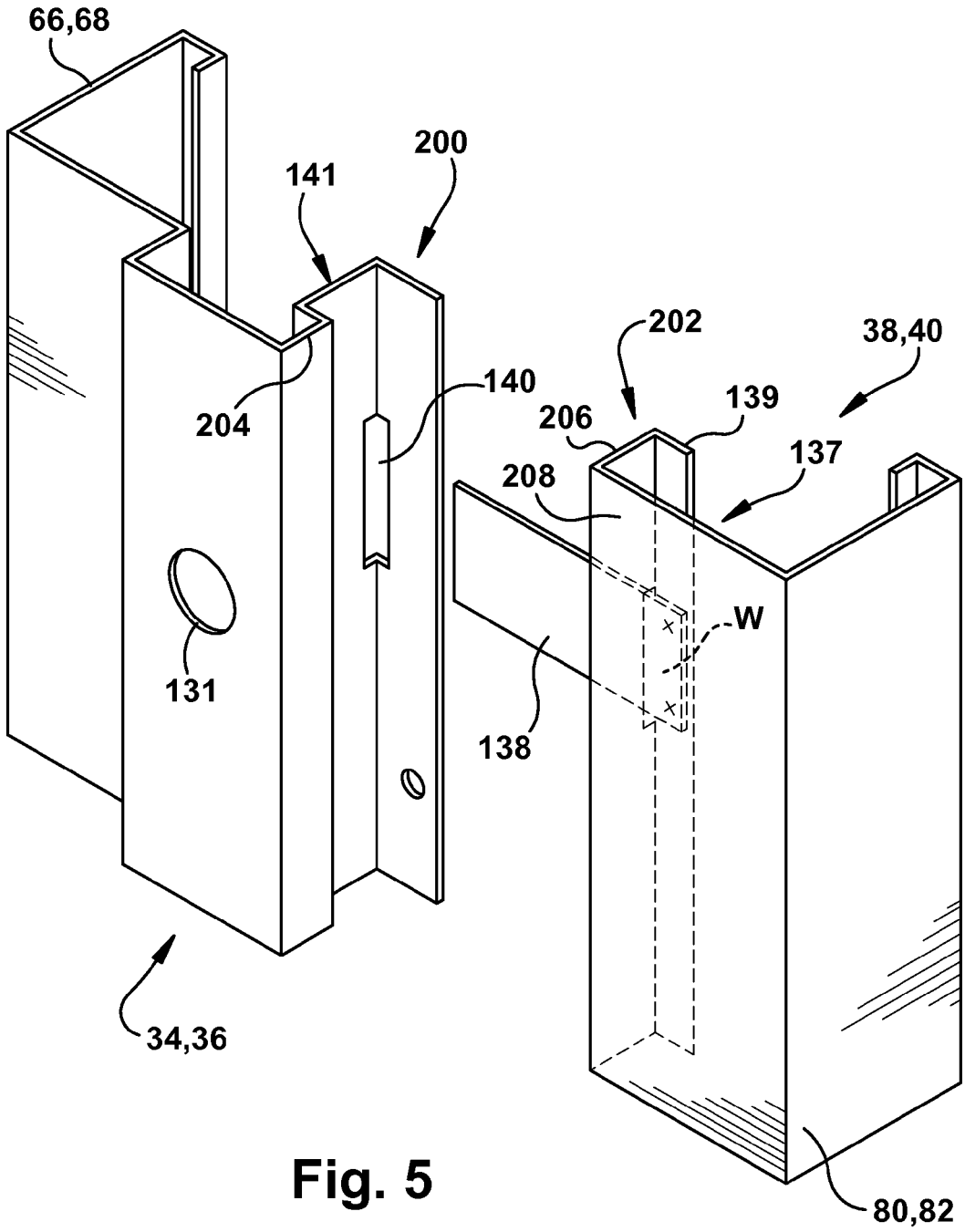
FIG. 5 is a partial exploded perspective view of an alignment and securing assembly constructed in accordance with one embodiment of the present disclosure.

The alignment header 42 includes a channel 58 formed by an alignment face plate 60 and connection flange 62. The alignment members 34, 36 abut the alignment face plate 60 at mitered ends 64 extending from alignment member face plates 66, 68 and the alignment face plate along a first exposed perimeter 70 of the wall 14 as illustrated in FIGS. 1 and 4. The cover header 44 includes a channel 72 formed by a cover face plate 74 and connection flange 76. The cover members 38, 40 abut the cover face plate 74 similarly to first exposed perimeter 70 at mitered ends 78 extending from cover member face plates 80, 82 (see also FIG. 5 and the cover face plate 74) along a second exposed perimeter 84. The connection flange 62 of the alignment header 42 overlaps and mates with the connection flange 76 of the cover header 44. A plurality of through holes 86 are located atop the connection flange 62 for passage of fasteners through the connection flange 62 fixedly attaching it to the header 16 of the rough opening 12.

Figure 6:
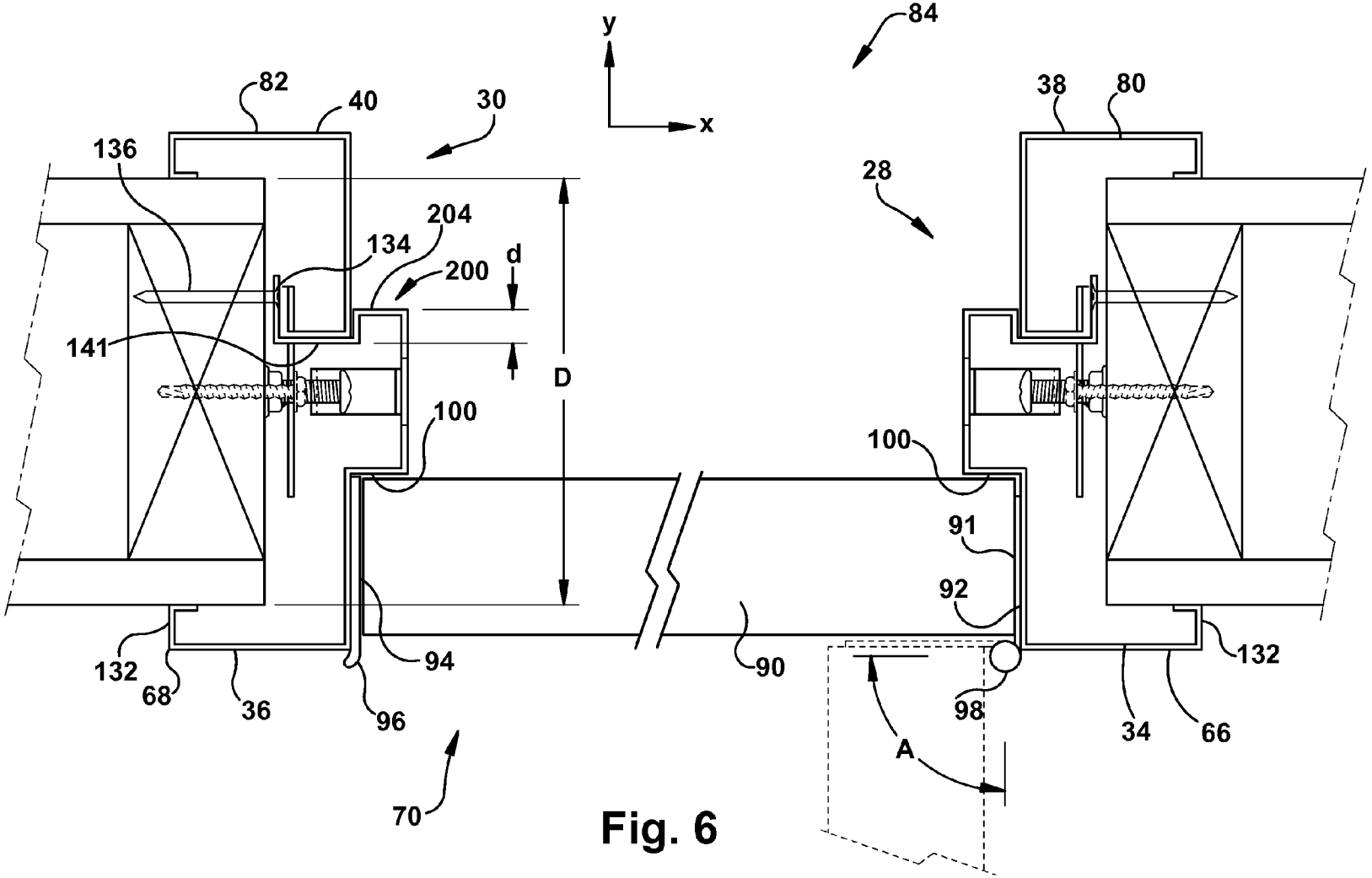
FIG. 6 is an elevated sectional view of an adjustable door frame assembly constructed in accordance with one embodiment of the present disclosure about section lines 6-6 in FIG. 1.

In the illustrated example embodiment of FIG. 6, the vertical jamb arrangements 28, 30 support a door 90 along a hinge flange 92 located on vertical jamb member 28 and along a hardware flange 94 located on vertical jamb member 30. As appreciated by one skilled in the art, the hinge flange 92 and hardware flange 94 could switched to be located on opposing vertical jamb members, depending on whether the door 90 is to be mounted left handed or right handed. Fixedly attached to the hardware flange 94 is a strike plate mechanism 96 that typically includes an opening for the door latch and an opening for a dead-bolt or lock (not shown). In one example embodiment, the door 90 is a metal or fire-proof door. In another example embodiment, the door 90 is a wooden or hollow-core door.

Figure 7A:
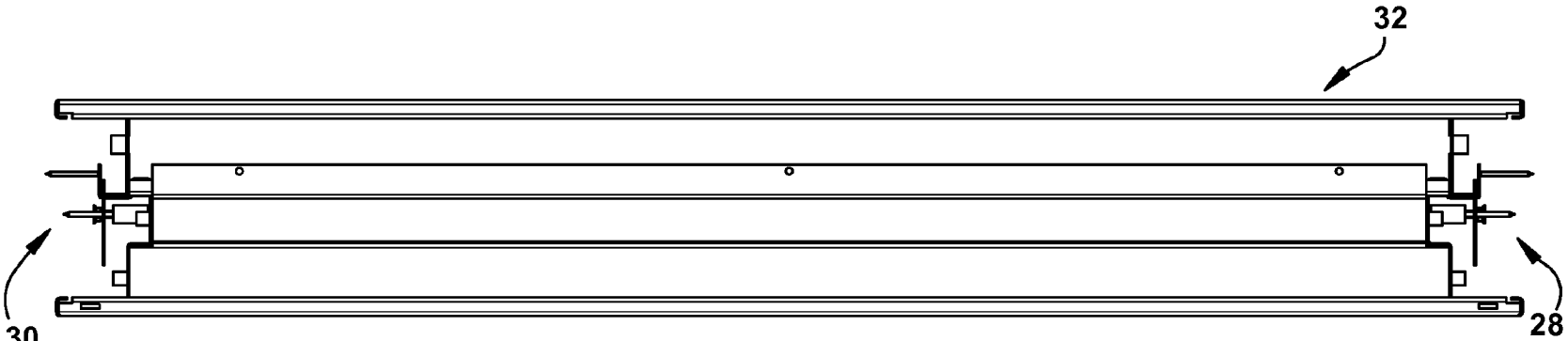
FIG. 7A is an inner view of an underside of a horizontal head assembly connected to vertical jamb assemblies in accordance with one embodiment of the present disclosure.
Figure 7B:
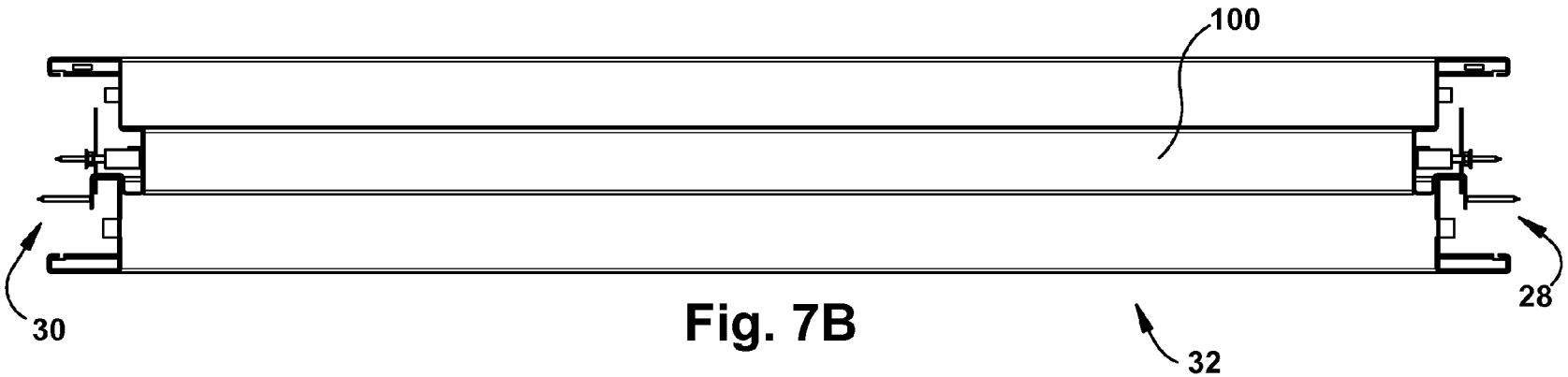
FIG. 7B is an outer view of an underside of a horizontal head assembly connected to vertical jamb assemblies in accordance with one embodiment of the present disclosure.

Fixedly attached (by fasteners or welding) to the hinge flange 92 and door 90 are a plurality of hinges 98 that support the weight of door and allow for rotating about the hinges during opening and closing of the door, as shown by arrows A. Illustrated in phantom, the door 90 is in an open position, while conversely the door shown in solid in FIG. 6 is located in a closed position. In a closed position, the door 90 engages a stop flange 100 located along the vertical jamb arrangements 28, and 30 and the horizontal head arrangement 32 (as shown in the top partial inner view of FIG. 7A) for terminating the rotation of the door during closing.

During installation, conventional doors are positioned within a door jamb structure such that the door and the door jamb structure are ideally squared and plumbed to the rough opening to achieve a smooth rotation during the opening and closing of the door while providing a tight seal between the door, header, and jambs. This process in conventional doors is time consuming and often requires use of several wooden shims unique in number and size for each door. The shims are positioned between the door jamb structure and rough opening to obtain the desired square and/or plumb fit. Such labor intensive and time consuming approach is advantageously eliminated by the teachings of the present disclosure. In particular, an alignment assembly 110 is provided and shown in the perspective-partial assembly view of FIG. 9, eliminates conventional wood shims and time needed in conventional door assemblies for squaring and/or plumbing (by way of making the door, vertical, and horizontal arrangements true and substantially perpendicular to the floor about the rough opening) the adjustable door frame assembly 10.

Figure 10:
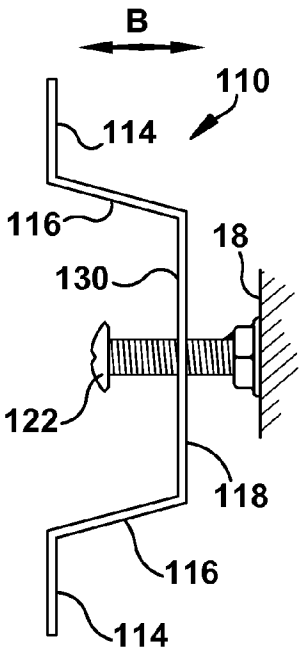
FIG. 10 is a side elevation view of FIG. 9.
Figure 9:
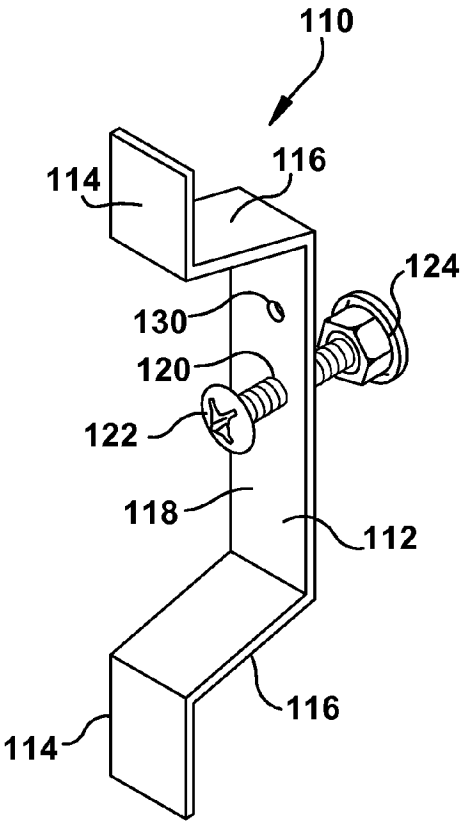
FIG. 9 is a partial perspective view of an alignment assembly constructed in accordance with one embodiment of the present disclosure.

The alignment assembly 110 as illustrated in FIGS. 9 and 10 comprises a fixture 112 formed from a single piece of metal or plastic having securing flanges 114 secured to offset arms 116 that attach at opposite ends of a body portion 118. In the illustrated example embodiment, the fixture 112 is made from 16 gauge steel, but could equally be any metal or plastic having similar or greater strength without departing from the spirit and scope of the present disclosure.

Centrally located about the body portion 118 is a tapped through-hole 120 with an internal thread for accommodating an adjustable stop 122. The adjustable stop 122 can be translated back and forth through the body portion 118, moving the alignment assembly 110 to and away (as indicated by Arrows B) from the vertical sides 18 of the rough opening 12, as illustrated in FIG. 10. In one example embodiment, the adjustable stop 122 is a ¼-20 round screw with a boss 124, such as a flange nut welded at the stop's end to distribute the load and prevent excessive penetration of the adjustable stop into the stud 22 or wall.

Figure 11:
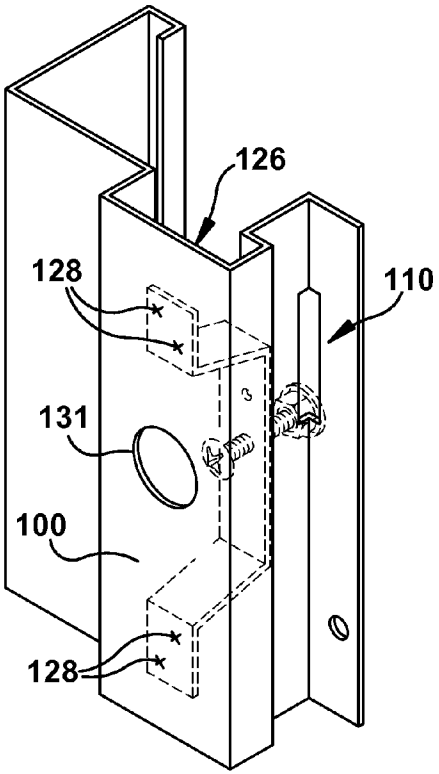
FIG. 11 is a perspective assembly view of an alignment assembly attached to an alignment member or alignment header.

In one example embodiment, a plurality of alignment assemblies 110 are located around the perimeter of the vertical jamb arrangements, 28, 30, and in particular are welded or adhesively attached along their securing flanges 114 to an inside perimeter 126 of the stop flange 100 as illustrated in FIG. 11. In the illustrated example embodiment, the alignment assemblies 110 are welded by spot or fillet welding 128 along the securing flanges 114 and inside perimeter 126 as would be appreciated by one skilled in the art. Annularly positioned about the adjustable stop 122 on the stop flange 100 for each of the alignment assemblies 110 is an access opening 131 that allows the adjustment of the adjustable stop 122. Symmetrically located above the adjustable stop in the body portion 118 is an aperture 130 used for passing a fastener for the securing of the cover members 38 and 40 to the rough opening 12, as will be discussed below in further detail.

During installation and the squaring and/or plumbing of the adjustable door frame assembly 10, the alignment members 34, 36, alignment header 42, and door 90 are uniformly positioned within the rough opening 12 of the wall 14. An outer locating flange 132 (see FIG. 6) positions the location of the alignment members 34, 36, and alignment header 42, and door 90 in a longitudinal direction Y about the rough opening 12, as illustrated in FIG. 6.

Once the alignment members 34, 36, alignment header 42, and door 90 are longitudinally located, the door, alignment members and alignment header are selectively positioned in a lateral direction X about the rough opening 12 as illustrated in FIG. 6 via the alignment assemblies 110. The alignment assemblies are adjusted in the lateral X direction until the door 90 is plumb and/or square, allowing for smooth rotation during the opening and closing of the door. In particular, the adjustable stop 122 is translated about the body portion 118 until the desired lateral displacement of the alignment members 34, 36, and alignment header 42 is obtained from the vertical sides 18 of the rough opening 12.

Figure 12C:
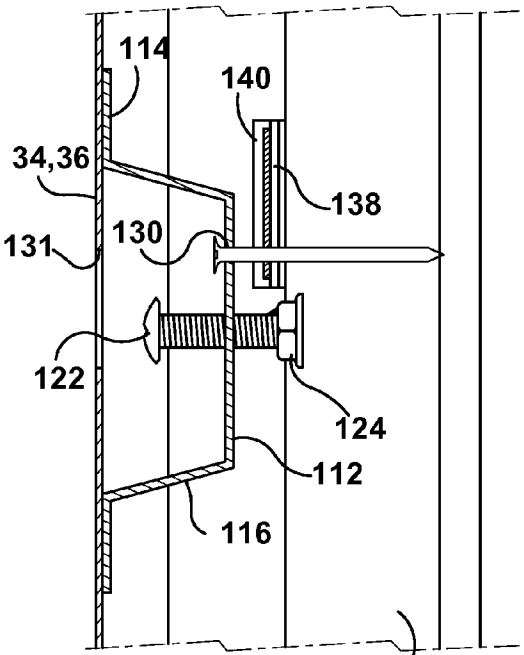
FIG. 12C is a sectional elevation view of FIG. 12A.
Figure 12A:
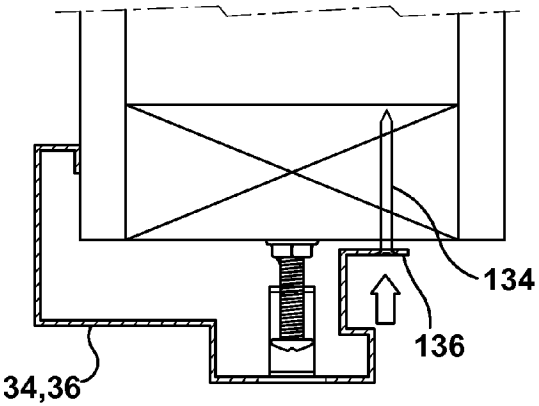
FIG. 12A is a sectional plan view of FIG. 11.
Figure 12B:
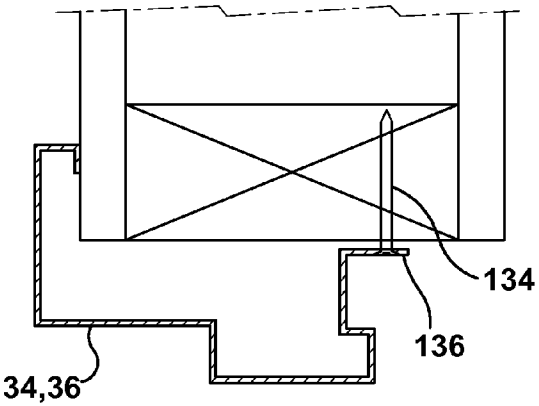
FIG. 12B is a sectional elevation view of an alignment header constructed in accordance with one embodiment of the present disclosure.

In the exemplary embodiment, the adjustable stop 122 moves the alignment members 34, 36, alignment header 42, and door 90 to and away from the vertical sides 18 by rotating the adjustable stop (see Arrows C in FIG. 8) with a phillips screw driver through the access opening 131 to the desired lateral position in each of the alignment assemblies 110 (see FIG. 3). Once the desired lateral position is achieved, fasteners 134 are used to secure the alignment members 34, 36, and alignment header 42 around the rough opening 12 perimeter by penetrating the fasteners through a securing lip 136 located along the alignment members and header (see FIGS. 12A and 12B). In one example embodiment, the fasteners 134 are nails or screws.

Figure 15A:
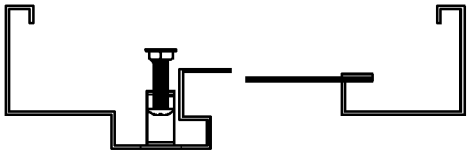
FIG. 15A is an exploded plan view of the securing system of FIG. 13.
Figure 15B:
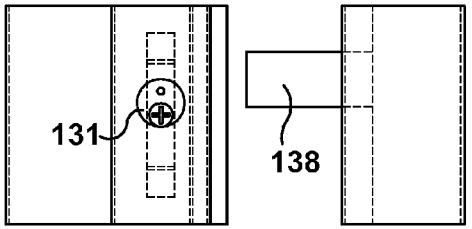
FIG. 15B is an exploded elevation view of the securing system of FIG. 13
Figure 16A:
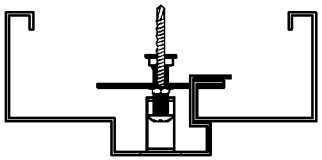
FIG. 16A is a plan view of a securing assembly constructed in accordance with one embodiment of the present disclosure.
Figure 16B:
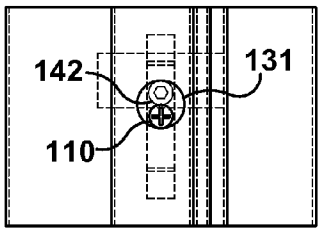
FIG. 16B is an elevation view of a securing assembly constructed in accordance with one embodiment of the present disclosure.

Once the desired lateral position of the alignment members 34, 36, and alignment header 42 is achieved, the cover members 38, 40 and cover header 44 are secured to the rough opening 12 through a fastening assembly 137 by the passing of a tab 138 welded ("W") along an interior flange 139 of the cover member 38, 40 through a corresponding slot 140 located in a channel 141 of the alignment member 34, 36 as illustrated in FIGS. 5, 6, and 14-16. The tab 138 and slot 140 are located such that the alignment assembly 110 is just below the tab when inserted thereby, avoiding any interference during assembly as can be appreciated in FIGS. 15B, 16B and 12C. The tab 138 and slot 140 are further located such that access opening 131 is in direct view of at least a portion of the tab 138 when inserted through the slot 140 as shown in FIGS. 15 and 16. Accordingly, during assembly, the cover members 38, 40 are secured to the rough opening 12 by passing a fastener 142 through access opening 131, the aperture 130 in the body portion 118, and into stud 22 or wall of the rough opening 12. In one example embodiment, the fastener 142 is a screw. In another example embodiment, the fastener 142 is a #10-16×1½" self tapping screw. After the fastener 142 is installed, a plug 152 is inserted in the access opening for aesthetic appeal. In an alternative example embodiment, the cover header 44 includes a tab 138 that passes through a corresponding slot 140 in the alignment header and is attached to the rough opening 12 in a similar fashion as the alignment members 34, 36 and cover members 38, 40 already shown and described. That is, the tab 138 is secured to the header 16 by passing a fastener through an opening 131 in the alignment header to engage the tab and header 16.

Figure 13:
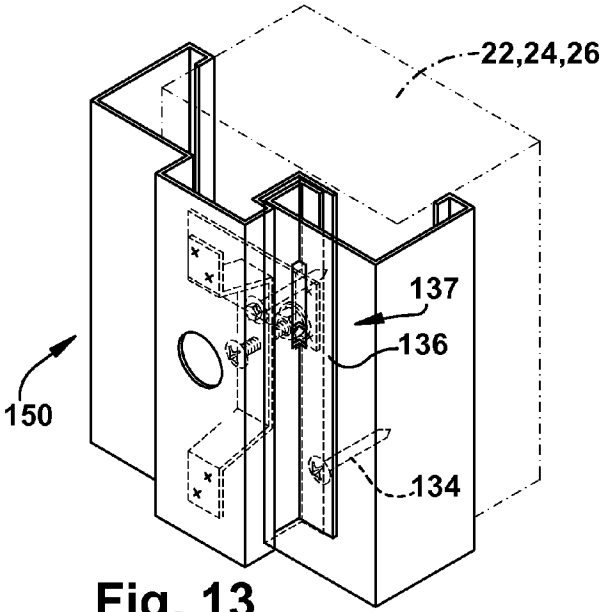
FIG. 13 is a perspective view of a securing system constructed in accordance with one embodiment of the present disclosure.
Figure 14:
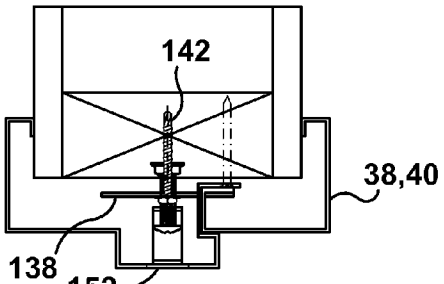
FIG. 14 is a sectional plan view of the securing system of FIG. 13.

Illustrated in FIG. 13 is an adjustable securing system 150 that comprises the alignment assembly 110 of FIG. 8 with access opening 131, and fastening assembly 137 of the tab 138. In one example embodiment, there are several securing systems located around the internal perimeter of the vertical jamb arrangements 28, 30, as shown in FIG. 1. In an alternative example embodiment, the horizontal head arrangement 32 includes one or more adjustable securing systems 150 for attaching the horizontal head arrangement to the header 16 of the rough opening 12.

Referring again to FIGS. 5 and 6 is yet another advantage provided by the present disclosure. In particular, the adjustable door frame assembly 10 includes a run-out region 200 that aids in concealing variations in wall 14 stack-up thicknesses indicated by dimension "D" in FIG. 6. The run-out region 200 is formed by the channel 141 located in the vertical jamb arrangements 28, 30, and horizontal jamb arrangement 32. The channel 141 receives a surround segment 202 of the cover member 38, 40, and cover header 44 that conceals any gap that may occur within dimension "d" by a lip portion 204 in the alignment members 34, 36, and alignment header 42, as a result of variations in wall thickness. The surround segment 202 comprises the interior flange 139, edge member 206 and portion of cover flange 208. In one example embodiment, the run-out region 200 conceals a variation in the wall 14 stack-up thicknesses indicated by dimension "D" up to a half of one inch (½") within run-out region "d". It should be appreciated however, that the run-out region 200 could be further increased to cover greater variation amounts without departing from the spirit and scope of the claimed disclosure.

Figure 17:
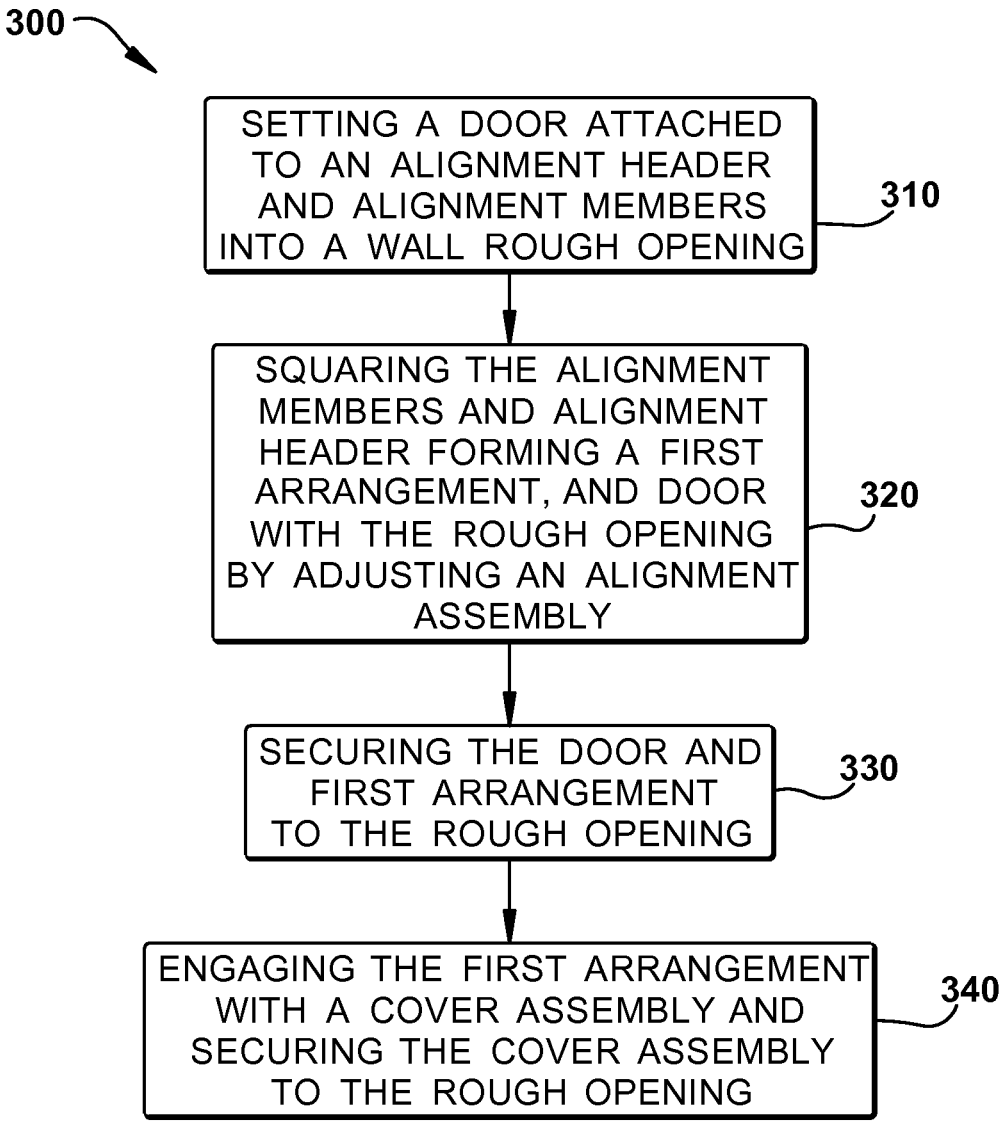
FIG. 17 is a flowchart of an exemplary embodiment of the present disclosure.

Referring now to FIG. 17 is a flowchart of an exemplary embodiment of the present disclosure illustrating a process 300 of installing an adjustable door frame assembly constructed in accordance with one embodiment of the present disclosure. At 310, the process 300 comprises setting a door attached to an alignment header and alignment members into a wall rough opening. At 320, the process 300 comprises squaring the alignment members, alignment header, and door with the rough opening by adjusting an alignment assembly. At 330, the process 300 comprises securing the alignment members, alignment header forming a first arrangement to the rough opening. At 340, the process 300 comprises engaging the first arrangement with a cover assembly and securing the cover assembly to the rough opening.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

What is claimed is:

1. An adjustable door frame assembly for framing a door opening, the adjustable door frame assembly comprising:

first and second alignment members providing a first securing structure to a door opening, one of said first and second alignment members being rotatably connected to a door during installation;

an alignment header connecting said first and second alignment members along an upper end of said alignment members;

an alignment assembly located within at least one of said first and second alignment members, said alignment assembly comprising an adjustable stop for locating said adjustable door frame assembly about said door opening; and first and second cover members providing a second securing structure to the door opening independently of said first securing structure;

wherein said alignment assembly further includes a fixture having a threaded opening rotatably supporting said adjustable stop such that the adjustable stop is rotated about the threaded opening to move the alignment members near or away from the opening by relative rotational movement of the adjustable stop; and wherein rotation of the adjustable stop causes displacement of one of said first and second alignment members in a direction laterally across the door opening.

2. The adjustable door frame assembly of claim 1 further comprising a cover header for connecting said first and second cover members along an upper end of said alignment members.

3. The adjustable door frame assembly of claim 1 wherein at least one of said first and second cover members further comprises a tab portion extending transversely from said cover member that is received by a corresponding slot located within one of said first and second alignment members during installation of the said first and second cover members.

4. The adjustable door frame assembly of claim 3 wherein said at least one of said first and second alignment members further comprises an access opening for entry of a fastener used to secure said tab portion of the door opening.

5. The adjustable door frame assembly of claim 1 wherein said adjustable stop further comprises a boss member for engaging the wall of said door opening.

6. The adjustable door frame assembly of claim 5 further comprising a plurality of alignment assemblies located in each of said first and second alignment members.

7. The adjustable door frame assembly of claim 1 further comprising a run-out region, the run-out region concealing variations in the width of the wall of the door opening.

8. The adjustable door frame assembly of claim 7 wherein said run-out region further comprises a lip portion forming a channel in said first and second alignment members and a surround segment formed by said cover members received within said channel.

* * * * *